US011049436B1

(12) United States Patent
Shin et al.

(10) Patent No.: US 11,049,436 B1
(45) Date of Patent: Jun. 29, 2021

(54) DISPLAY PANEL AND DISPLAY DEVICE INCLUDING THE SAME

(71) Applicant: Samsung Display Co., Ltd., Yongin-Si (KR)

(72) Inventors: Dong Hee Shin, Asan-si (KR); GeunHo Lee, Hwaseong-si (KR); Yonghee Lee, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/005,383

(22) Filed: Aug. 28, 2020

(30) Foreign Application Priority Data

Feb. 11, 2020 (KR) ..... 10-2020-0016548

(51) Int. Cl.
*G09G 3/20* (2006.01)

(52) U.S. Cl.
CPC ..... *G09G 3/2092* (2013.01); *G09G 2310/027* (2013.01)

(58) Field of Classification Search
CPC ..... G09G 3/2092; G09G 2310/027
See application file for complete search history.

(56) References Cited

U.S. PATENT DOCUMENTS 9,188,799 B2 11/2015 Lee et al.
10,204,564 B2 2/2019 No et al.
2015/0062106 A1* 3/2015 Hwang ..... G09G 3/20 345/212
2017/0140698 A1* 5/2017 Hwang ..... G11C 19/28
2017/0162147 A1* 6/2017 Kim ..... G11C 19/287
2017/0219895 A1* 8/2017 Yu ..... G02F 1/1368
2019/0288008 A1* 9/2019 Park ..... G09G 3/3266
2020/0133327 A1* 4/2020 Lee ..... G09G 3/2092

FOREIGN PATENT DOCUMENTS

KR 10-2015-0002322 A 1/2015
KR 10-2015-0071516 A 6/2015
KR 10-2017-0013460 A 2/2017
KR 10-2017-0080848 A 7/2017
KR 10-1896377 B1 9/2018

* cited by examiner

*Primary Examiner* — Andrew Sasinowski
(74) *Attorney, Agent, or Firm* — Innovation Counsel LLP

(57) ABSTRACT

A display device may include a first display substrate. The first display substrate may include a first line disposed in the non-display region to apply a common voltage to the display region, a gate driving circuit disposed in the non-display region between the display region and the first line, gate lines connected to the gate driving circuit, and a second line disposed between the first line and the gate driving circuit. The gate driving circuit may include clock signal lines, each of which receives a clock signal, and stage circuits connected to corresponding ones of the clock signal lines and the gate lines to output gate signals. The second line may be disposed between the first line and one of the clock signal lines disposed closest to the first line and may be electrically disconnected from the stage circuits.

20 Claims, 11 Drawing Sheets

DISPLAY PANEL AND DISPLAY DEVICE INCLUDING THE SAME

CROSS-REFERENCE TO RELATED APPLICATIONS

This U.S. non-provisional patent application claims priority under 35 U.S.C. § 119 to Korean Patent Application No. 10-2020-0016548, filed on Feb. 11, 2020, in the Korean Intellectual Property Office, the entire contents of which are hereby incorporated by reference.

BACKGROUND

The present disclosure relates to a display panel and a display device including the same, and in particular, to a display panel having an improved interconnection structure and a display device including the same.

A display device includes a plurality of gate lines, a plurality of data lines, and a plurality of pixels connected to the gate and data lines. The display device further includes a gate driving circuit sequentially outputting gate signals to the gate lines and a data driving circuit sequentially outputting data signals to the data lines. The gate driving circuit includes a shift resister, which is composed of a plurality of stages that are dependently connected to each other. Each of the stages includes a plurality of transistors which are connected to each other to output a gate voltage to a corresponding one of the gate lines.

The display device includes a display panel with two display substrates. One of them may be an array substrate, and the other may be an opposing substrate. The array substrate includes a plurality of gate lines, a plurality of data lines, and a plurality of transistors connected to the gate and data lines. The transistors may constitute the pixel.

SUMMARY

An embodiment of the inventive concept provides a highly-reliable display panel with an improved interconnection structure and a display device including the same.

According to an embodiment of the inventive concept, a display device may include a first display substrate which includes a display region in which pixels are disposed and a non-display region disposed adjacent to the display region. The first display substrate may include a first line disposed in the non-display region to apply a common voltage to the display region, a gate driving circuit disposed in the non-display region between the display region and the first line, a plurality of gate lines connected to the gate driving circuit, and a second line disposed between the first line and the gate driving circuit. The gate driving circuit may include a plurality of clock signal lines, each of which receives a clock signal, and stage circuits connected to a corresponding one of the clock signal lines and a corresponding one of the gate lines to output gate signals. The second line may be disposed between the first line and one of the clock signal lines which is disposed closest to the first line, and may be electrically disconnected from the stage circuits.

In an embodiment, the second line may receive a ground voltage.

In an embodiment, the second line may be provided in plural.

In an embodiment, the second line may be a floating line that is electrically isolated.

In an embodiment, the first display substrate may further include a third line disposed between the gate driving circuit and the second line.

In an embodiment, one of the second line and the third line may receive a ground voltage, and the other may be a floating line that is electrically isolated.

In an embodiment, the display device may further include a second display substrate facing the first display substrate. The second display substrate may include a base substrate and a common electrode disposed on the base substrate, and the common electrode may receive the common voltage.

In an embodiment, the display device may further include a sealant combining the first display substrate with the second display substrate. The sealant may cover the plurality of clock signal lines, the first line, and the second line.

In an embodiment, the first line, the second line, and the clock signal lines may be formed of a same material and disposed on the same layer.

In an embodiment, any signal line may not be disposed between an edge of the first display substrate which is disposed closest to the first line and the first line in a plan view.

In an embodiment, each of the stage circuits may include at least one driving transistor.

In an embodiment, the pixel may include a pixel transistor, which outputs a pixel voltage in response to a corresponding one of the gate signals, and the pixel transistor and the at least one driving transistor may have the same stacking structure.

In an embodiment, a control electrode of the pixel transistor, a control electrode of the at least one driving transistor, and the first line may be formed of a same material and disposed on the same layer.

According to an embodiment of the inventive concept, a display panel may include a first display substrate including a display region and a non-display region disposed adjacent to the display region, a second display substrate facing the first display substrate, and a sealant overlapped with the non-display region to combine the first display substrate with the second display substrate. The first display substrate may include a common line disposed in the non-display region to apply a common voltage to the display region, a gate driving circuit disposed in the non-display region, the gate driving circuit including a plurality of clock signal lines and a stage circuit, which is connected to the plurality of clock signal lines, and at least one shield line disposed between the common line and the gate driving circuit. The at least one shield line may be disposed between the common line and one of the clock signal lines which is disposed closest to the common line, and may be electrically disconnected from the stage circuits.

In an embodiment, the second display substrate may include a common electrode in contact with the sealant, and the common electrode may receive the common voltage.

In an embodiment, a distance between the common line and one of the clock signal lines which is disposed closest to the common line may be larger than a distance between the clock signal lines.

In an embodiment, a width of the at least one shield line may be smaller than a width of the common line and widths of the plurality of clock signal lines.

In an embodiment, a width of the at least one shield line may range from 10 μm to 15 μm.

In an embodiment, the at least one shield line may apply a ground signal to the display region.

In an embodiment, the display panel may further include a plurality of data driving circuits, which are arranged in a first direction, and each of which includes a circuit board and a driving chip. The data driving circuits may include a first data driving circuit and a second data driving circuit, which are disposed at opposite sides of the display panel, and an end of each of the common line and the shield line may be connected to the first data driving circuit and an opposite end of each of the common line and the shield line may be connected to the second data driving circuit.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

Figure 1:
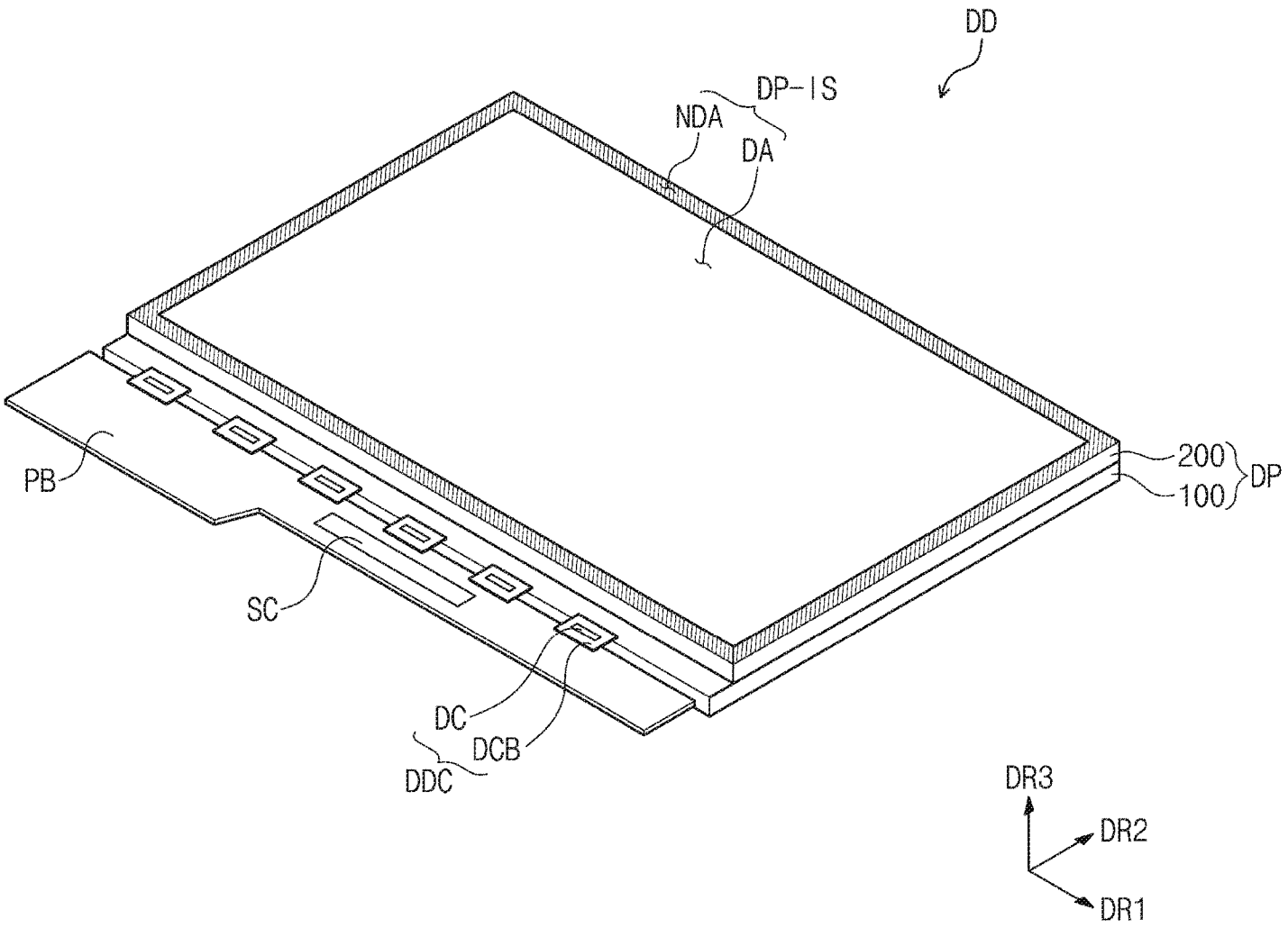
FIG. 1 is a perspective view illustrating a display device according to an embodiment of the inventive concept.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION

Example embodiments of the inventive concepts will now be described more fully with reference to the accompanying drawings, in which example embodiments are shown. Example embodiments of the inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments of the inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the inventive concepts should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 2A:
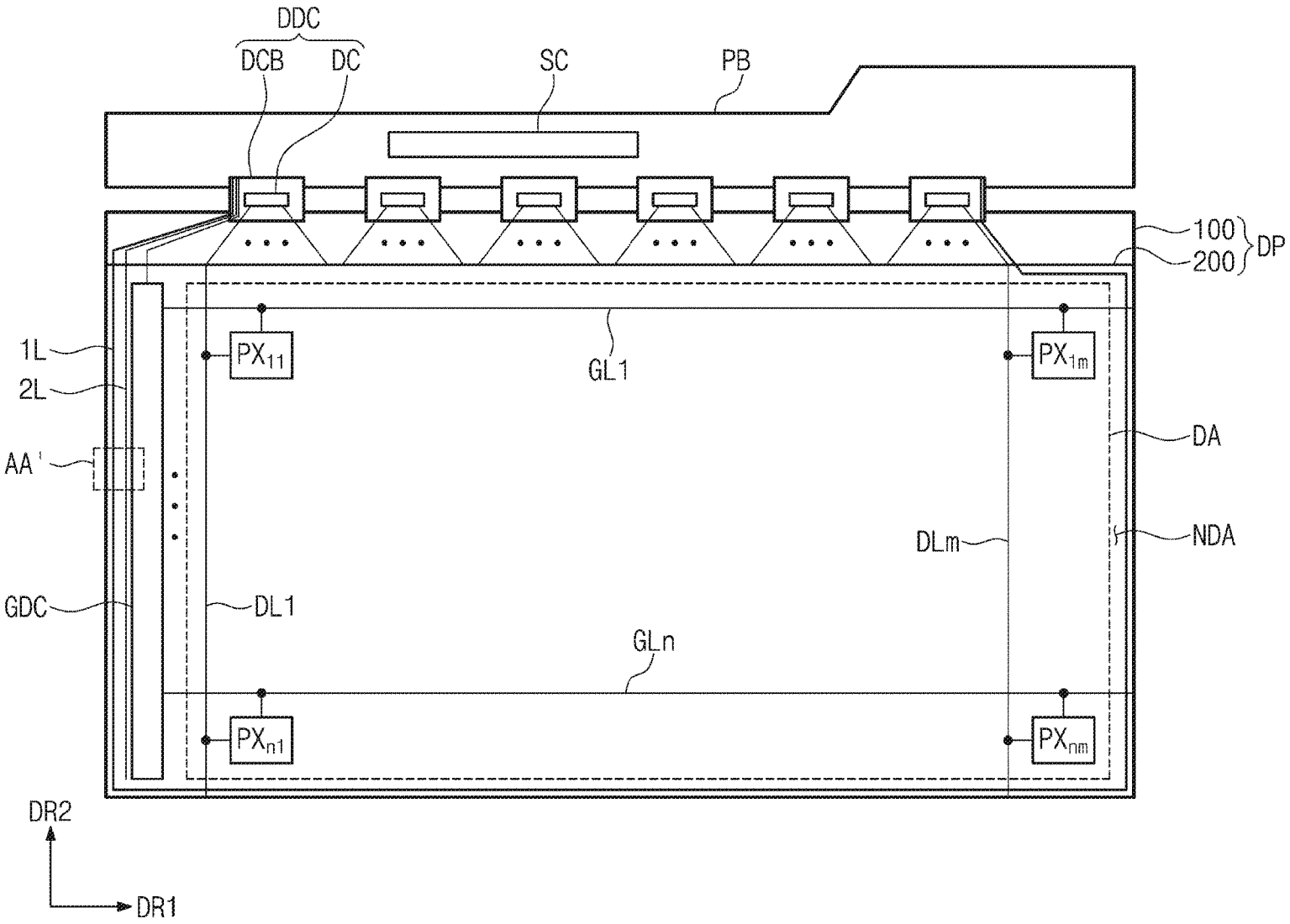
FIGS. 2A and 2B are plan views illustrating a display device according to an embodiment of the inventive concept.
Figure 2B:
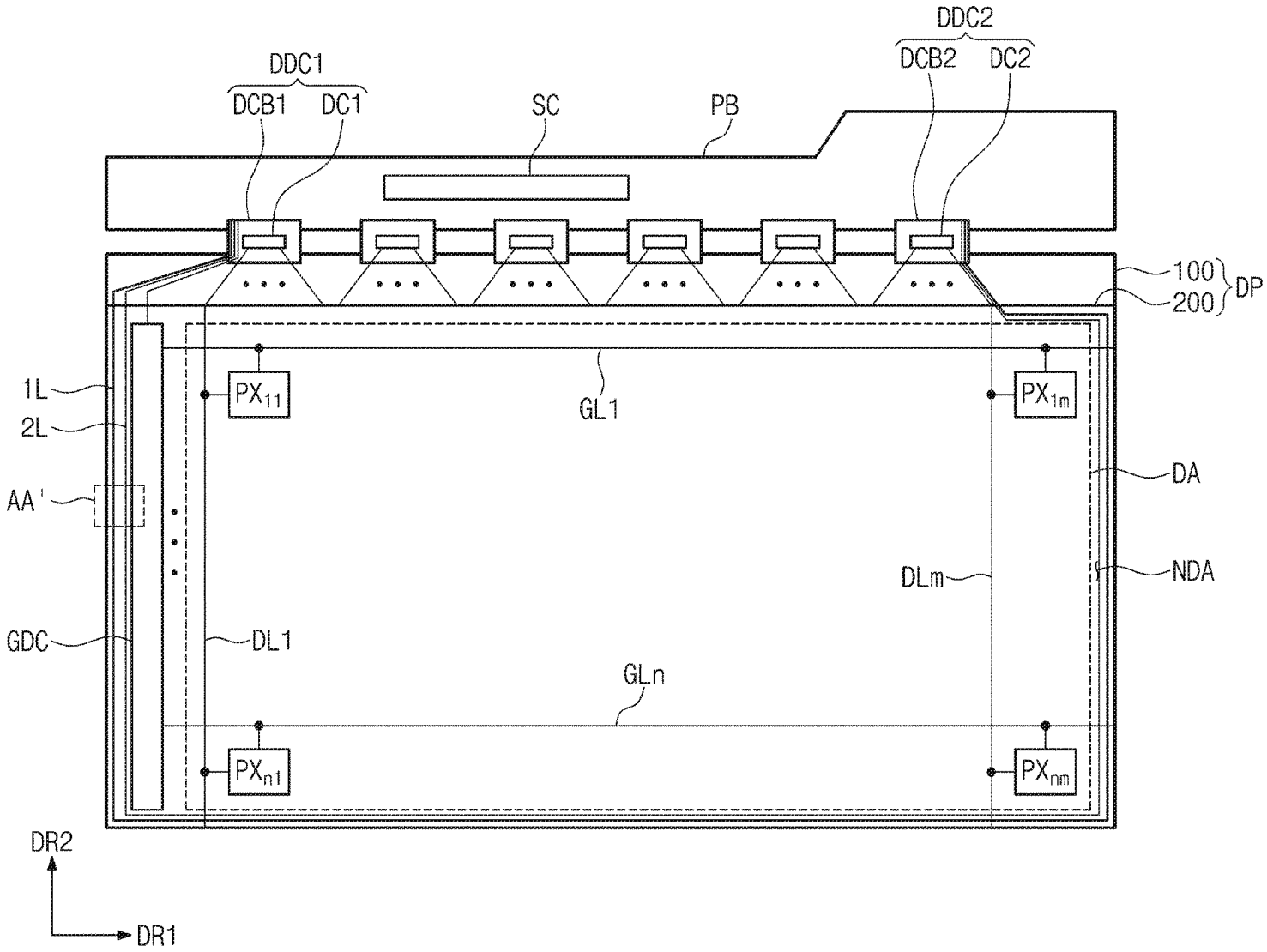
Figure 3:
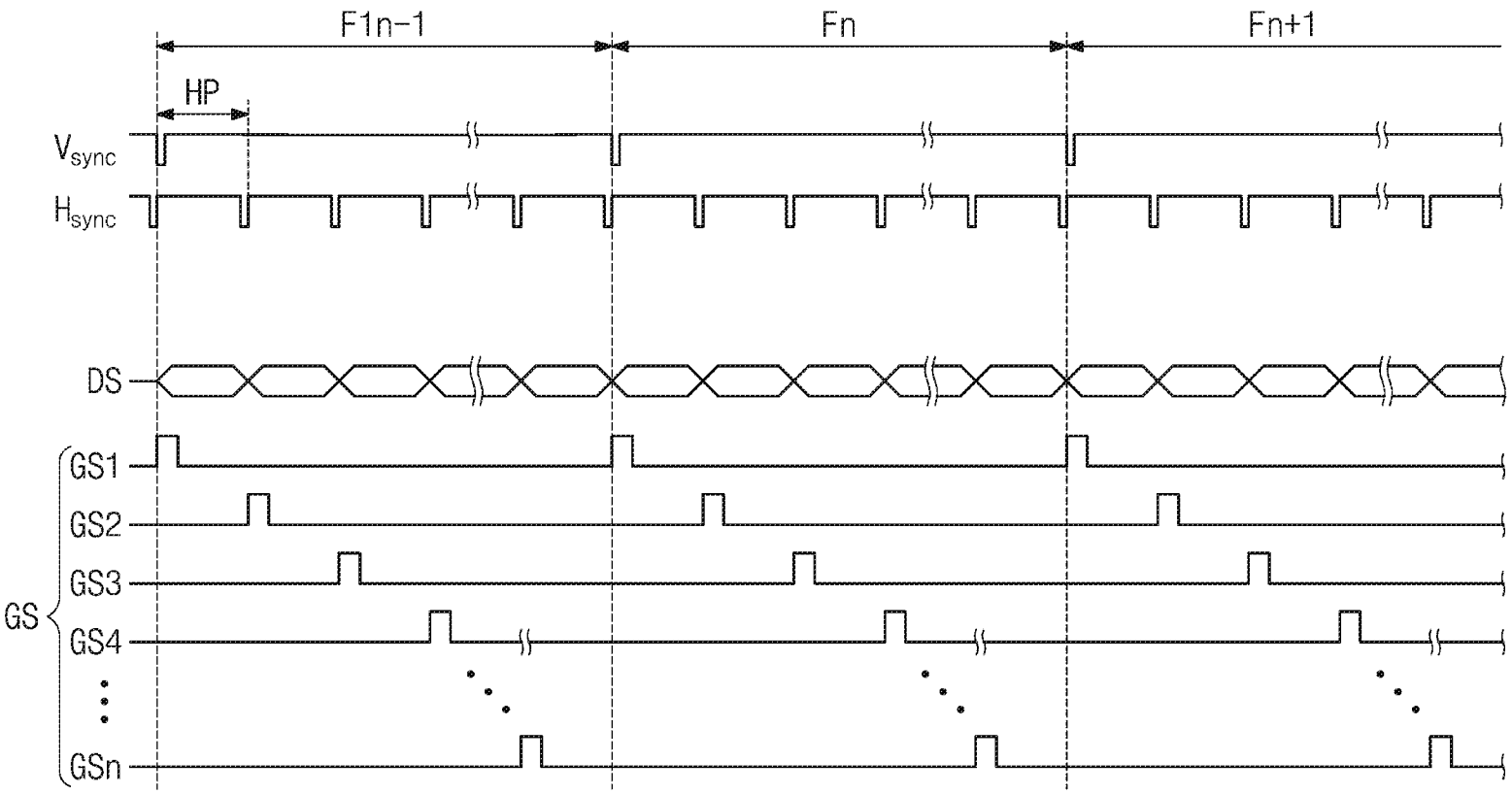
FIG. 3 is a timing diagram illustrating a driving signal according to an embodiment of the inventive concept.

FIG. 1 is a perspective view illustrating a display device DD according to an embodiment of the inventive concept. FIGS. 2A and 2B are plan views illustrating a display device DD according to an embodiment of the inventive concept. FIG. 3 is a timing diagram illustrating a driving signal according to an embodiment of the inventive concept.

Referring to FIGS. 1, 2A, and 2B, the display device DD may include a display panel DP, a data driving circuit DDC, a main circuit board PB, a gate driving circuit GDC, and a signal control circuit SC. Although not shown, the display device DD may further include a chassis or a molding and may further include a backlight unit, depending on the kind of the display panel DP.

The display panel DP may be one of a liquid crystal display panel, a plasma display panel, an electrophoretic display panel, a microelectromechanical system (MEMS) display panel, an electrowetting display panel, and an organic light emitting display panel, but the inventive concept is not limited to these examples.

The inventive concept is not limited to a specific type of the gate driving circuit GDC. The gate driving circuit GDC may be configured to generate various scan signals as well as gate signals, depending on the kind of the display panel DP, but in an embodiment, the gate driving circuit GDC may be configured to merely generate the scan signals.

The display panel DP may include a first display substrate 100 and a second display substrate 200, which is spaced apart from the first display substrate 100 to face the first display substrate 100. The first display substrate 100 and the second display substrate 200 may be spaced a predetermined distance apart for each other. A gradation display layer to generate an image may be disposed between the first display substrate 100 and the second display substrate 200. The gradation display layer may be one that is chosen from a display device layer, such as a liquid crystal layer, an organic light emitting layer, and an electrophoretic layer, depending on the kind of the display panel DP.

As shown in FIG. 1, the display panel DP may include a display surface DP-IS, which is used to display an image. The display surface DP-IS may be parallel to a plane defined by a first direction axis DR1 and a second direction axis DR2. The display surface DP-IS may include a display region DA and a non-display region NDA. The non-display region NDA may be defined along a border of the display surface DP-IS to enclose the display region DA. The display region DA may be defined as the same region in the first display substrate 100 and the second display substrate 200.

A direction normal to the display surface DP-IS (i.e., a thickness direction of the display panel DP) will be referred to as a third direction axis DR3. The third direction DR3 may be used to differentiate a front or top surface of each element (e.g., a layer or a unit) from a back or bottom surface. However, the first to third direction axes DR1, DR2, and DR3 illustrated in the present embodiment may be just an example. Hereinafter, first to third directions may be directions indicated by the first to third direction axes DR1, DR2, and DR3, respectively, and will be identified with the same reference numbers as the first to third direction axes DR1, DR2, and DR3.

In an embodiment, the display panel DP is illustrated to have a flat-type display surface, but the inventive concept is not limited to this example. The display surface of the display device DD may have a curved or three-dimensional shape. The three-dimensional display surface may include a plurality of display regions that are oriented in different directions.

A sealant (not shown) may be disposed between the first display substrate 100 and the second display substrate 200 to combine the first display substrate 100 with the second display substrate 200. The sealant may be disposed in the non-display region NDA and may have a closed-line-shaped pattern formed along an edge of the first display substrate 100. The cell gap may be maintained by the sealant.

In an embodiment a plurality of the data driving circuits DDC may be arranged in the first direction DR1. Each of the data driving circuits DDC may include a circuit board DCB and a driving chip DC. The circuit board DCB may be a flexible printed circuit board. The circuit board DCB may have a structure in which insulating and conductive layers are stacked. The conductive layer may include a plurality of signal lines. The data driving circuit DDC may be coupled to the first display substrate 100 to be electrically coupled to signal lines of the display panel DP. The inventive concept is not limited to a specific coupling structure of the data driving circuit DDC and the display panel DP.

The data driving circuits DDC may include a first data driving circuit DDC1 and a second data driving circuit DDC2 which are disposed at opposite sides of the display panel DP along a first direction DR1. For example, the first data driving circuit DDC1 may be the first one of the data driving circuits DDC arranged in the first direction DR1 and the second data driving circuit DDC2 may be the last one of the data driving circuits DDC arranged in the first direction DR1.

The main circuit board PB may be connected to the circuit board DCB of the data driving circuit DDC. The main circuit board PB may be electrically coupled to the circuit board DCB through an anisotropic conductive film, a solder ball, or the like. The signal control circuit SC may be mounted on the main circuit board PB. The signal control circuit SC may be a timing controller. The signal control circuit SC may receive image data and control signals from an external graphic control unit (not shown). The signal control circuit SC may provide the control signal to the data driving circuit DDC. In an embodiment, the driving chip DC of the data driving circuit DDC may be mounted on the main circuit board PB.

FIGS. 2A and 2B illustrate an example of planar arrangement of signal lines GL1 to GLn and DL1 to DLm and pixels PX11 to PXnm which are included in the display panel DP. The signal lines GL1 to GLn and DL1 to DLm may include a plurality of gate lines GL1 to GLn and a plurality of data lines DL1 to DLm. In the present embodiment, the gate lines GL1 to GLn may serve as scan lines.

The gate lines GL1 to GLn may extend in the first direction DR1 and may be arranged in the second direction DR2, and the data lines DL1 to DLm may be disposed to cross the gate lines GL1 to GLn with an insulating layer disposed therebetween. The gate lines GL1 to GLn and the data lines DL1 to DLm may be disposed in the display region DA.

The gate lines GL1 to GLn may be connected to the gate driving circuit GDC. Just one gate driving circuit GDC is illustrated in the drawings, but in an embodiment, a plurality of gate driving circuits GDC may be arranged in the second direction DR2. In addition, the gate driving circuit GDC is disposed at one side of the display device DD, but the gate driving circuit GDC may be disposed at opposite sides of the display device DD in the first direction DR1. In an embodiment, the gate driving circuit GDC may be directly integrated onto the first display substrate 100 through an oxide silicon gate driver circuit (OSG) or amorphous silicon gate driver circuit (ASG) process.

Each of the pixels PX11 to PXnm may be connected to a corresponding one of the gate lines GL1 to GLn and a corresponding one of the data lines DL1 to DLm. Each of the pixels PX11 to PXnm may include a pixel driving circuit and a display element.

The pixels PX11 to PXnm may be classified into a plurality of groups based on their display colors. Each of the pixels PX11 to PXnm may display one of primary colors. The primary colors may include red, green, and blue. However, the inventive concept is not limited to these examples, and the colors displayed by the pixels PX11 to PXnm may include yellow, cyan, and magenta. Although the pixels PX11 to PXnm are illustrated to be arranged in a matrix shape, the inventive concept is not limited to this example. For example, the pixels PX11 to PXnm may be arranged in a pentile shape.

The gate driving circuit GDC and the data driving circuit DDC may receive control signal from the signal control circuit SC. The signal control circuit SC may receive image data and control signals from an external graphic controller (not shown).

In an embodiment, the display device DD may include a first line 1L and a second line 2L disposed on the first display substrate 100 of the display panel DP. The first line 1L may be used to apply a common voltage Vcom and may be referred to as a common line. Here, the line may indicate an interconnection line which includes a conductive material. The first line 1L may be disposed on the non-display region NDA to surround the gate driving circuit GDC. The first line 1L may be disposed at a region that is farther from the display region DA than the gate driving circuit GDC. In an embodiment, the first line 1L may include two opposite ends which are respectively connected to the first data driving circuit DDC1 and the second data driving circuit DDC2 to surround the display region DA. Such a connection is not limited to a specific manner. The first line 1L may extend to enclose the display region DA and may be disposed along three edge portions of the non-display region NDA.

The second line 2L may be disposed between the first line 1L and the gate driving circuit GDC. The second line 2L may be used to shield the first line 1L from the gate driving circuit GDC and may be electrically disconnected from stage circuits SRC1 to SRCn in the gate driving circuit GDC.

The second line 2L may be disposed along one edge portion of the non-display region NDA between the first line 1L and the gate driving circuit GDC. In an embodiment, the second line 2L may extend along a side of the gate driving circuit GDC to have at least a length corresponding to the gate driving circuit GDC in the second direction DR2. In another embodiment, the second line 2L may include two opposite ends which are respectively connected to the first data driving circuit DDC1 and the second data driving circuit DDC2. For example, similar to the first line 1L, the second line 2L may extend to enclose the display region DA and may be disposed along three edge portions of the non-display region NDA. The second line 2L may receive a ground voltage.

As shown in FIG. 3, the control signal may include a vertical synchronization signal Vsync which is used to distinguish frame periods Fn−1, Fn, and Fn+1, a horizontal synchronization signal Hsync which is used to distinguish horizontal periods HP or is used as a row distinction signal, a data enable signal which is used to indicate a data input period or is in a high level only during a data output period, and clock signals.

The gate driving circuit GDC may generate gate signals GS1 to GSn and may output the gate signals GS1 to GSn to the gate lines GL1 to GLn, respectively in response to a control signal (hereinafter, a gate control signal) that is received from the signal control circuit SC during the frame periods Fn−1, Fn, and Fn+1. The gate signals GS1 to GSn may be sequentially output corresponding to the horizontal periods HP. Each of the gate signals GS1 to GSn may serve as a turn-on signal of a pixel transistor TR which will be described below.

The data driving circuit DDC may generated gray scale voltages corresponding to the image data provided from the signal control circuit SC, in response to the control signal (hereinafter, a data control signal) received from the signal control circuit SC. The data driving circuit DDC may output the gray scale voltages, which serve as data voltages DS, to the data lines DL1 to DLm.

The data voltages DS may include positive and negative data voltages which have positive and negative values with respect to the common voltage. During each of the horizontal periods HP, some of the data voltages DS applied to the data lines DL1 to DLm may have positive values and the others may have negative values.

Figure 4:
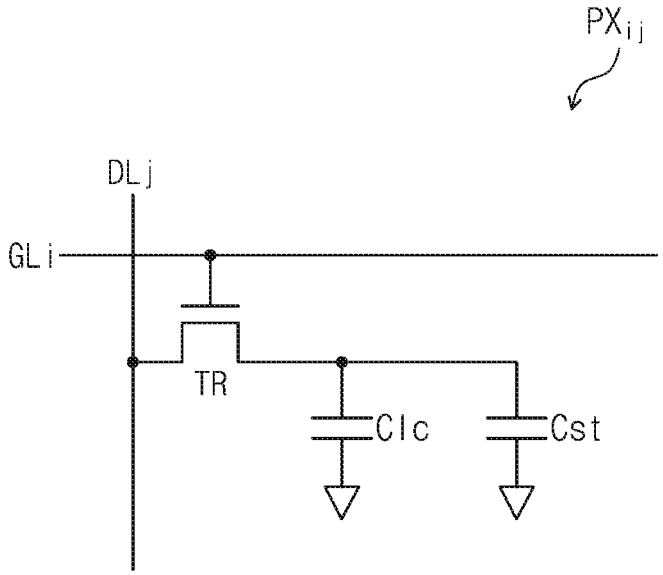
FIG. 4 is an equivalent circuit diagram illustrating a pixel according to an embodiment of the inventive concept.
Figure 5:
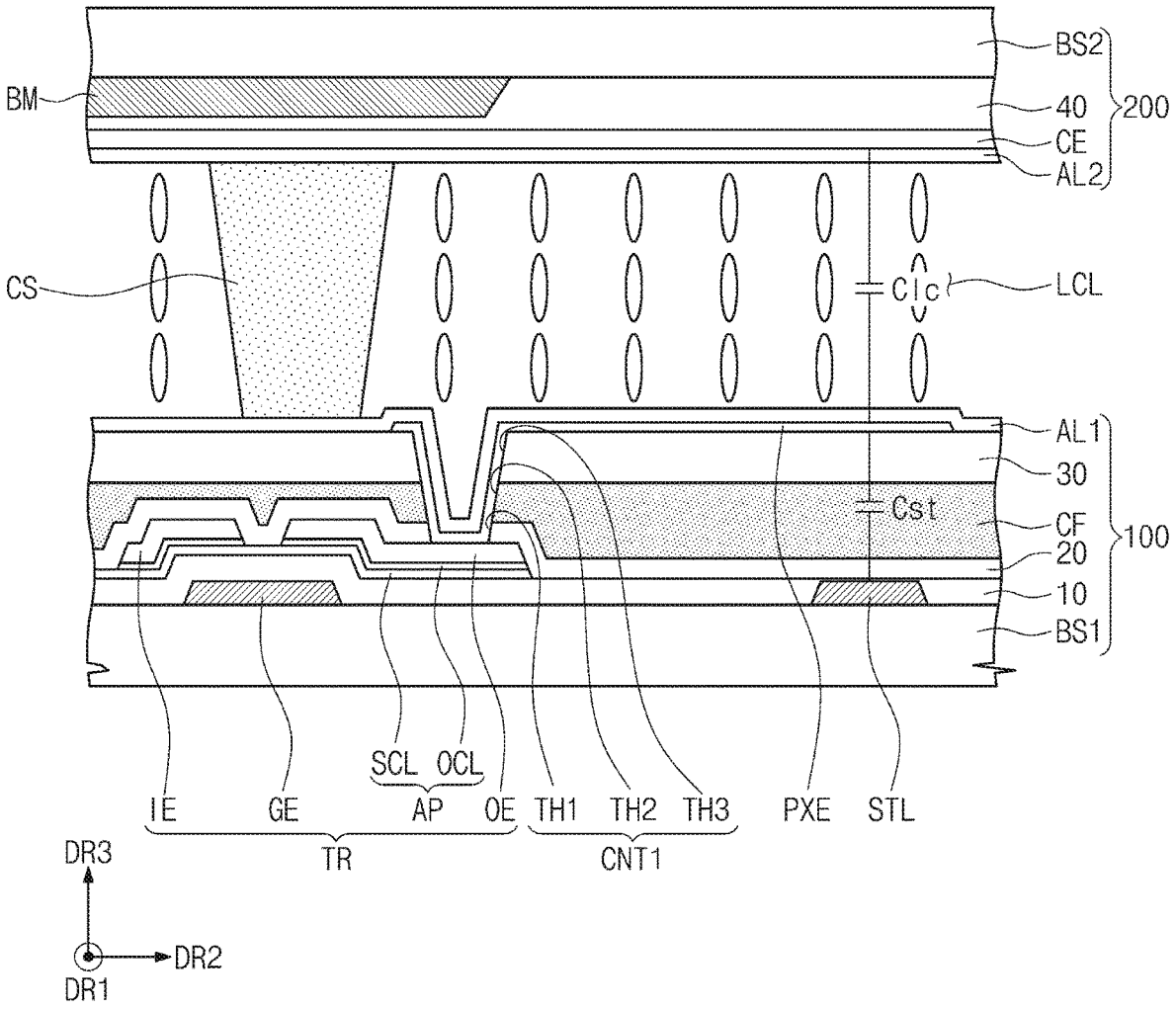
FIG. 5 is a sectional view illustrating a display panel according to an embodiment of the inventive concept.

FIG. 4 is an equivalent circuit diagram illustrating a pixel PXij according to an embodiment of the inventive concept. FIG. 5 is a sectional view illustrating the display panel DP according to an embodiment of the inventive concept.

FIG. 4 illustrates an example of a pixel PXij connected to an i-th gate line GLi and a j-th data line DLj. Hereinafter, a liquid crystal display panel will be described as an example of the display panel DP. Although FIG. 4 illustrates an equivalent circuit diagram of the pixel PXij, which is one of the pixels PX11 to PXnm shown in FIG. 2, all of the pixels PX11 to PXnm of FIG. 2 may have the same structure.

The pixel PXij may include a pixel transistor TR, a liquid crystal capacitor Clc, and a storage capacitor Cst. In an embodiment, the storage capacitor Cst may be omitted. In an embodiment, the pixel PXij may include two or more transistors or may include two or more liquid crystal capacitors.

The pixel transistor TR may be electrically connected to the i-th gate line GLi and the j-th data line DLj. The pixel transistor TR may output a pixel voltage corresponding to the data signal received from the j-th data line DLj in response to the gate signal received from the i-th gate line GLi.

The liquid crystal capacitor Clc may be charged by a pixel voltage output from the pixel transistor TR. An orientation of liquid crystals included in a liquid crystal layer LCL (e.g., see FIG. 5) may vary depending on an amount of charges stored in the liquid crystal capacitor Clc. Light incident into the liquid crystal layer may be transmitted or blocked depending on the orientation of the liquid crystals.

The storage capacitor Cst may be connected in parallel to the liquid crystal capacitor Clc. The storage capacitor Cst may maintain the orientation or arrangement of the liquid crystals for a predetermined period of time.

Referring to FIG. 5, the liquid crystal capacitor Clc may include a pixel electrode PXE and a common electrode CE which are spaced apart from each other with the liquid crystal layer LCL interposed therebetween. In addition, the pixel electrode PXE and a portion of a storage line STL may constitute the storage capacitor Cst. The storage line STL may receive a storage voltage different from the pixel voltage. The storage voltage may be the same as the common voltage.

FIG. 5 illustrates a cross-section corresponding to the pixel PXij. Referring to FIG. 5, a plurality of insulating layers 10, 20, and 30, the pixel transistor TR, and the pixel electrode PXE may be disposed on a surface of a first base substrate BS1. The gate and data lines connected to the pixel transistor TR are not shown in FIG. 5.

The first base substrate BS1 may be a glass substrate or a plastic substrate. A control electrode GE may be disposed on an inner surface (e.g., a top surface in FIG. 5) of the first base substrate BS1. The control electrode GE may be a portion of the gate line or may be a portion that is horizontally extended from the gate line. A first insulating layer 10 may be formed on a surface of the first base substrate BS1 to cover the control electrode GE. The first insulating layer 10 may be formed of or include at least one of inorganic or organic materials. In the present embodiment, the first insulating layer 10 may be an inorganic layer. For example, the first insulating layer 10 may be formed of or include at least one of silicon nitride, silicon oxynitride, silicon oxide, titanium oxide, or aluminum oxide.

An activation pattern AP overlapped with the control electrode GE may be disposed on the first insulating layer 10. The activation pattern AP may include a semiconductor layer SCL and an ohmic contact layer OCL. The semiconductor layer SCL may be disposed on the first insulating layer 10, and the ohmic contact layer OCL may be disposed on the semiconductor layer SCL.

The semiconductor layer SCL may be formed of or include amorphous silicon or poly silicon. In addition, the semiconductor layer SCL may be formed of or include at least one of metal oxide semiconductor materials. The ohmic contact layer OCL may be doped to have a doping concentration higher than that of the semiconductor layer SCL. The ohmic contact layer OCL may include two portions spaced apart from each other with a channel region disposed therebetween. In an embodiment, the ohmic contact layer OCL may be provided as a single object.

An input electrode IE and an output electrode OE may be disposed on the activation pattern AP to cover the ohmic contact layer OCL. A second insulating layer 20 may be formed on the first insulating layer 10 to cover the input electrode IE and the output electrode OE. The second insulating layer 20 may be formed of or include at least one of inorganic or organic materials. In the present embodiment, the second insulating layer 20 may be an inorganic layer. For example, the second insulating layer 20 may be formed of or include at least one of silicon nitride, silicon oxynitride, silicon oxide, titanium oxide, or aluminum oxide.

A color filter CF may be disposed on the second insulating layer 20. The color filter CF may have one of red, green, and blue colors. In an embodiment, the color filter CF may be omitted. The color filter CF may be disposed on the second display substrate 200.

A third insulating layer 30 may be disposed on the color filter CF. The third insulating layer 30 may be an organic layer having a flat top surface. The third insulating layer 30 may be formed of or include an acrylic resin.

The pixel electrode PXE may be disposed on the third insulating layer 30. The pixel electrode PXE may be formed of or include transparent conductive oxide (TCO). The pixel electrode PXE may be formed of or include at least one of indium tin oxide (ITO), indium zinc oxide (IZO), zinc oxide (ZnO), indium tin zinc oxide (ITZO), PEDOT, metal nano wire, or graphene.

The pixel electrode PXE may be connected to the output electrode OE through a contact hole CNT1 formed in the second insulating layer 20, the color filter CF, and the third insulating layer 30. A first contact hole TH1 exposing an output electrode OE1 may be formed in the second insulating layer 20, a second contact hole TH2 corresponding to the first contact hole TH1 may be formed in the color filter CF, and a third contact hole TH3 corresponding to the second contact hole TH2 may be formed in the third insulating layer 30.

A first alignment layer AL1 may be disposed on the third insulating layer 30 to cover the pixel electrode PXE. The first alignment layer AL1 may be formed of or include a poly imide resin.

Referring to FIG. 5, a light-blocking pattern BM may be disposed on a bottom surface of a second base substrate BS2. The second base substrate BS2 may be a glass substrate or a plastic substrate. In addition, the light-blocking pattern BM may be overlapped with the gate line GLi and the data line DLj shown in FIG. 4.

Insulating layers may be formed on an inner surface (e.g., a bottom surface in FIG. 5) of the second base substrate BS2 to cover the light-blocking pattern BM. A fourth insulating layer 40, which is one of the insulating layers and provides a flat surface, is exemplarily illustrated in FIG. 5. The fourth insulating layer 40 may be an organic layer.

The common electrode CE may be disposed on a bottom surface of the fourth insulating layer 40. The common voltage Vcom (e.g., see FIG. 6) may be applied to the common electrode CE. The common voltage may be different from the pixel voltage. A second alignment layer AL2 may be disposed on a bottom surface of the common electrode CE.

A column spacer CS may be disposed between the first display substrate 100 and the second display substrate 200. The column spacer CS may maintain the cell gap. The column spacer CS may be formed of or include at least one of insulating materials. The column spacer CS may include a synthetic resin. The column spacer CS may be formed of or include a photo-sensitive organic material. The column spacer CS may be overlapped with a region of the display region DA, on which the light-blocking pattern BM is disposed. The column spacer CS may be overlapped with the pixel transistor TR. Nevertheless, the section of the display panel DP shown in FIG. 5 is just one example. The vertical positions of the first and second display substrates 100 and 200 may be changed or reversed in the third direction DR3.

So far, a liquid crystal display panel of a vertical alignment (VA) mode has been exemplarily described, but in an embodiment, the inventive concept may be applied to liquid crystal display panels of an in-plane switching (IPS) mode, a fringe-field switching (FFS) mode, a plane-to-line switching (PLS) mode.

Figure 6:
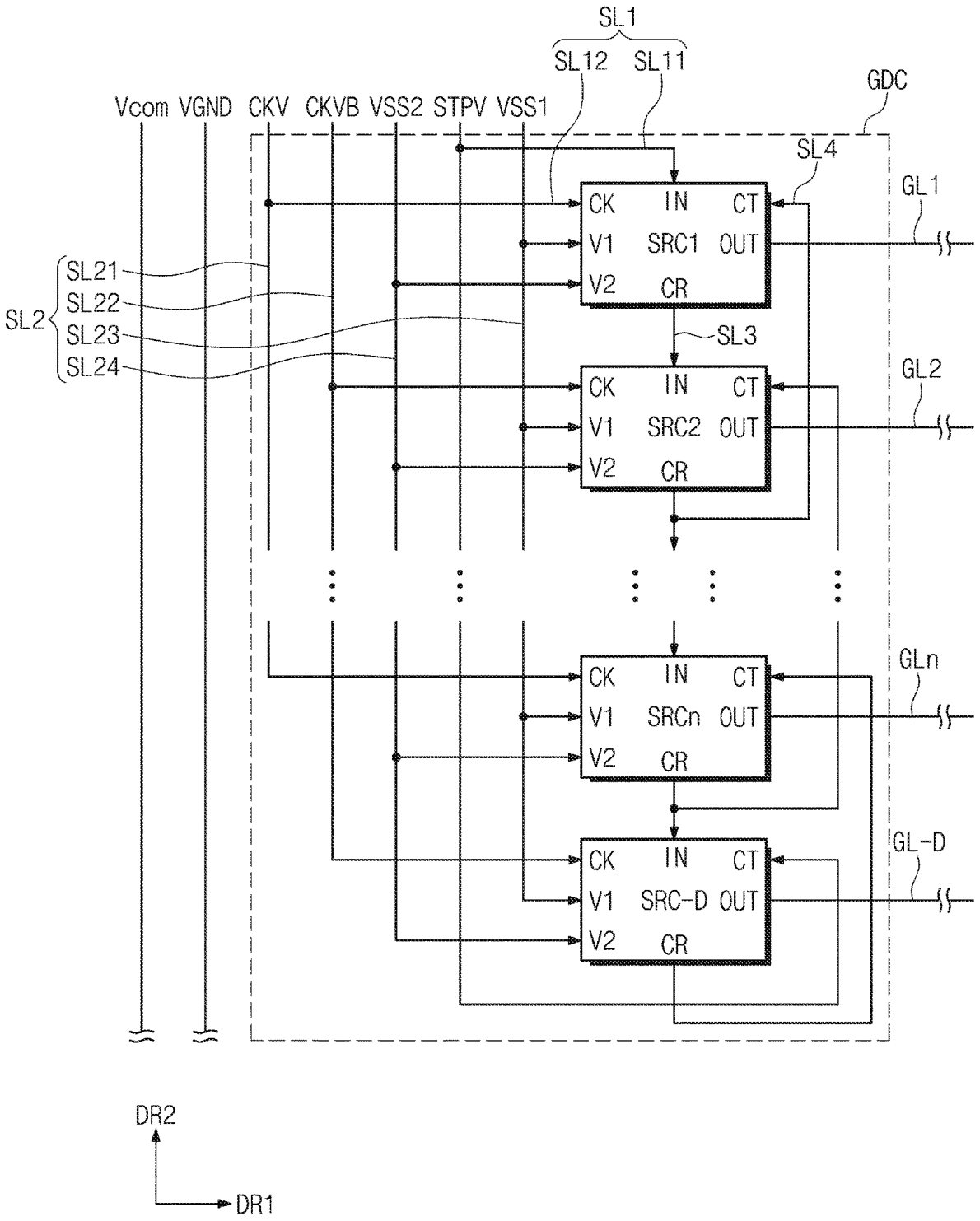
FIG. 6 is a block diagram illustrating a display panel according to an embodiment of the inventive concept.

FIG. 6 is a block diagram illustrating the display panel DP according to an embodiment of the inventive concept. FIG. 6 illustrates an example of the gate driving circuit GDC of FIGS. 2A and 2B. The gate driving circuit GDC may be disposed to be overlapped with the non-display region NDA. Referring back to FIGS. 2A and 2B, the common voltage Vcom may correspond to the first line 1L disposed adjacent to the gate driving circuit GDC, and a ground voltage VGND may correspond to the second line 2L disposed between the first line 1L and the gate driving circuit GDC.

FIG. 6 illustrates an example in which just one gate driving circuit GDC is provided, but the inventive concept is not limited to this example. For example, in an embodiment, a plurality of gate driving circuits GDC may be provided. In this case, a clock signal CKV and a clock bar signal CKVB shown in FIG. 6 may also be provided as a plurality of clock signals CKV and a plurality of clock bar signals CKVB.

Referring to FIG. 6, the gate driving circuit GDC may include a plurality of signal lines SL1, SL2, SL3, and SL4 and the stage circuits SRC1 to SRCn connected to the signal lines SL1, SL2, SL3, and SL4. The stage circuits SRC1 to SRCn may be arranged in the second direction DR2. The stage circuits SRC1 to SRCn may be dependently connected to each other. The stage circuits SRC1 to SRCn may be connected to the gate lines GL1 to GLn, respectively. The stage circuits SRC1 to SRCn may provide the gate signals GS1 to GSn (e.g., see FIG. 3) to the gate lines GL1 to GLn, respectively. In an embodiment, the gate lines GL1 to GLn connected to the stage circuits SRC1 to SRCn may be odd-numbered gate lines or even-numbered gate lines of the entire gate lines.

The gate driving circuit GDC may further include a dummy stage circuit SRC-D, which is connected to the last one (i.e., SRCn) of the stage circuits SRC1 to SRCn. The dummy stage circuit SRC-D may be connected to a dummy gate line GL-D.

The signal lines SL1, SL2, SL3, and SL4 may include a first signal line SL1 which is used to deliver an initiation signal STV. The first signal line SL1 may include a first sub-signal line SL11 which is connected to the first one (e.g., SRC1) of the stage circuits SRC1 to SRCn, and a second sub-signal line SL12 which is connected to one of the clock signal CKV.

The signal lines SL1, SL2, SL3, and SL4 may include a second signal line SL2 receiving the clock signals CKV and CKVB, and reference voltages VSS1 and VSS2. The second signal line SL2 may extend in the second direction DR2.

The second signal line SL2 may include a first sub-signal line SL21 receiving the clock signal CKV, a second sub-signal line SL22 receiving the clock bar signal CKVB, a third sub-signal line SL23 receiving a first reference voltage VSS1, and a fourth sub-signal line SL24 receiving a second reference voltage VSS2. The clock signal CKV and the clock bar signal CKVB may be clock signals whose phases are inverted with respect to each other. The first reference voltage VSS1 and the second reference voltage VSS2 may be bias voltages and may have different levels from each other. In the present embodiment, the reference voltages VSS1 and VSS2 may be discharge voltages.

When the odd-numbered stage circuits receive the clock signal CKV, the even-numbered stage circuits may receive the clock bar signal CKVB.

The signal lines SL1, SL2, SL3, and SL4 may include a third signal line SL3 providing a carry signal which is output from a previous one of the stage circuits SRC1 to SRCn, to a next stage circuit. The signal lines SL1, SL2, SL3, and SL4 may include a fourth signal line SL4 providing a signal which is output from a next stage circuit of the stage circuits SRC1 to SRCn to a previous stage circuit.

Each of the stage circuits SRC1 to SRCn may include an output terminal OUT, a carry terminal CR, an input terminal IN, a control terminal CT, a clock terminal CK, a first voltage input terminal V1, and a second voltage input terminal V2.

The output terminal OUT of each of the stage circuits SRC1 to SRCn may be connected a corresponding one of the gate lines GL1 to GLn. The gate signals GS1 to GSn which are generated by the stage circuits SRC1 to SRCn may be provided to the gate lines GL1 to GLn through the output terminal OUT.

The carry terminal CR of each of the stage circuits SRC1 to SRCn may be electrically connected to the input terminal IN of a next stage circuit. The carry terminal CR of each of the stage circuits SRC1 to SRCn may output a carry signal.

The input terminal IN of each of the stage circuits SRC1 to SRCn may receive the carry signal from the previous stage circuit. For example, the input terminal IN of the third stage circuits SRC3 may receive the carry signal from the second stage circuit SRC2. The input terminal IN of the first stage circuit SRC1 of the stage circuits SRC1 to SRCn may receive the initiation signal STV which initiates the driving of the gate driving circuit GDC instead of the carry signal from the previous stage circuit.

The control terminal CT of each of the stage circuits SRC1 to SRCn may be electrically connected to the carry terminal CR of a next stage circuit. The control terminal CT of each of the stage circuits SRC1 to SRCn may receive the carry signal from the next stage circuit. For example, the control terminal CT of the second stage circuit SRC2 may receive the carry signal that is output from the carry terminal CR of the third stage circuit SRC3. In an embodiment, the control terminal CT of each of the stage circuits SRC1 to SRCn may be electrically connected to the output terminal OUT of the next stage circuit.

The control terminal CT of the last stage circuit SRCn may receive the carry signal that is output from the carry terminal CR of the dummy stage circuit SRC-D. The control terminal CT of the dummy stage circuit SRC-D may receive the initiation signal STV.

The clock terminal CK of each of the stage circuits SRC1 to SRCn may receive one of the clock signal CKV and the clock bar signal CKVB. Each of the clock terminals CK of the odd-numbered ones (e.g., SRC1 and SRC3) of the stage circuits SRC1 to SRCn may receive the clock signal CKV. Each of the clock terminals CK of the even-numbered ones (e.g., SRC2 and SRCn) of the stage circuits SRC1 to SRCn may receive the clock bar signal CKVB.

The first voltage input terminal V1 of each of the stage circuits SRC1 to SRCn may receive the first reference voltage VSS1. The second voltage input terminal V2 of each of the stage circuits SRC1 to SRCn may receive the second reference voltage VSS2. The second reference voltage VSS2 may have a level lower than the first reference voltage VSS1.

In an embodiment, at least one of the output terminal OUT, the input terminal IN, the carry terminal CR, the control terminal CT, the clock terminal CK, the first voltage input terminal V1, and the second voltage input terminal V2 may be omitted from each of the stage circuits SRC1 to SRCn depending on its circuit structure, and in certain embodiments, other terminals may be further provided in each of the stage circuits SRC1 to SRCn. For example, one of the first and second voltage input terminals V1 and V2 may be omitted. In addition, the connection structure between the stage circuits SRC1 to SRCn may also be changed.

Figure 7A:
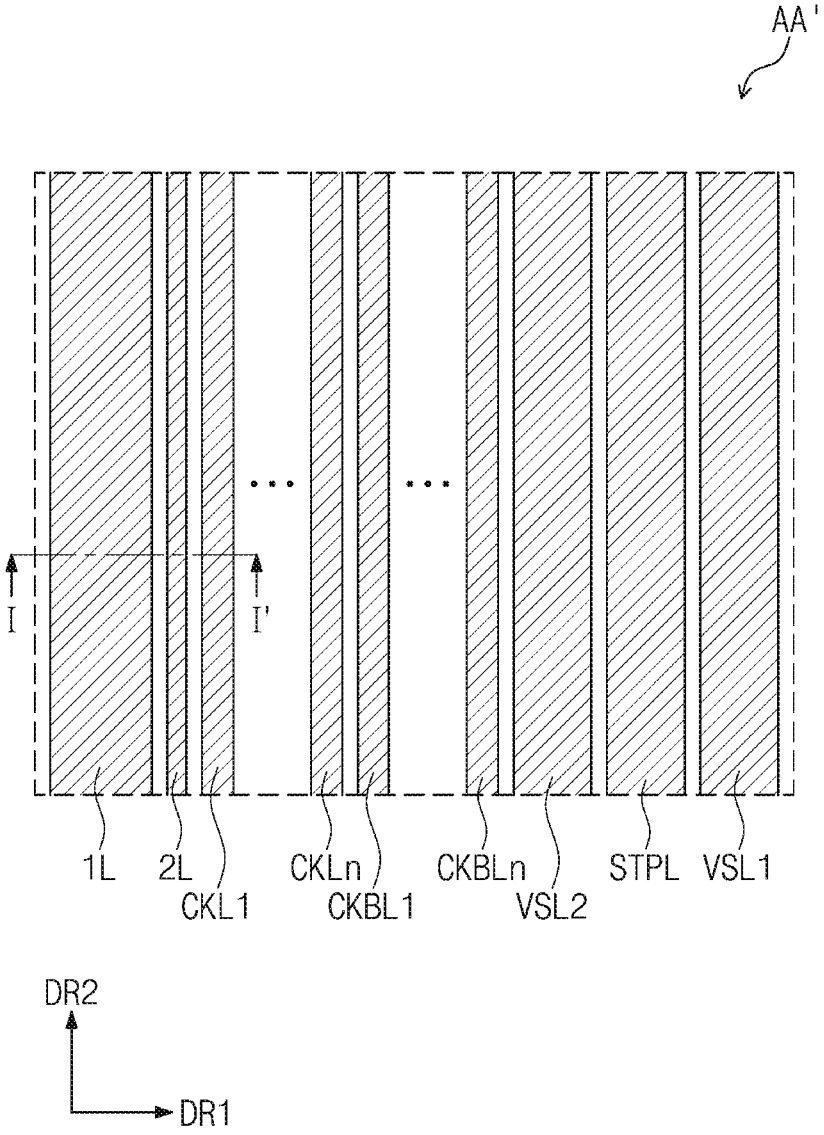
FIG. 7A is an enlarged plan view illustrating a region AA' of FIG. 2A.
Figure 7B:
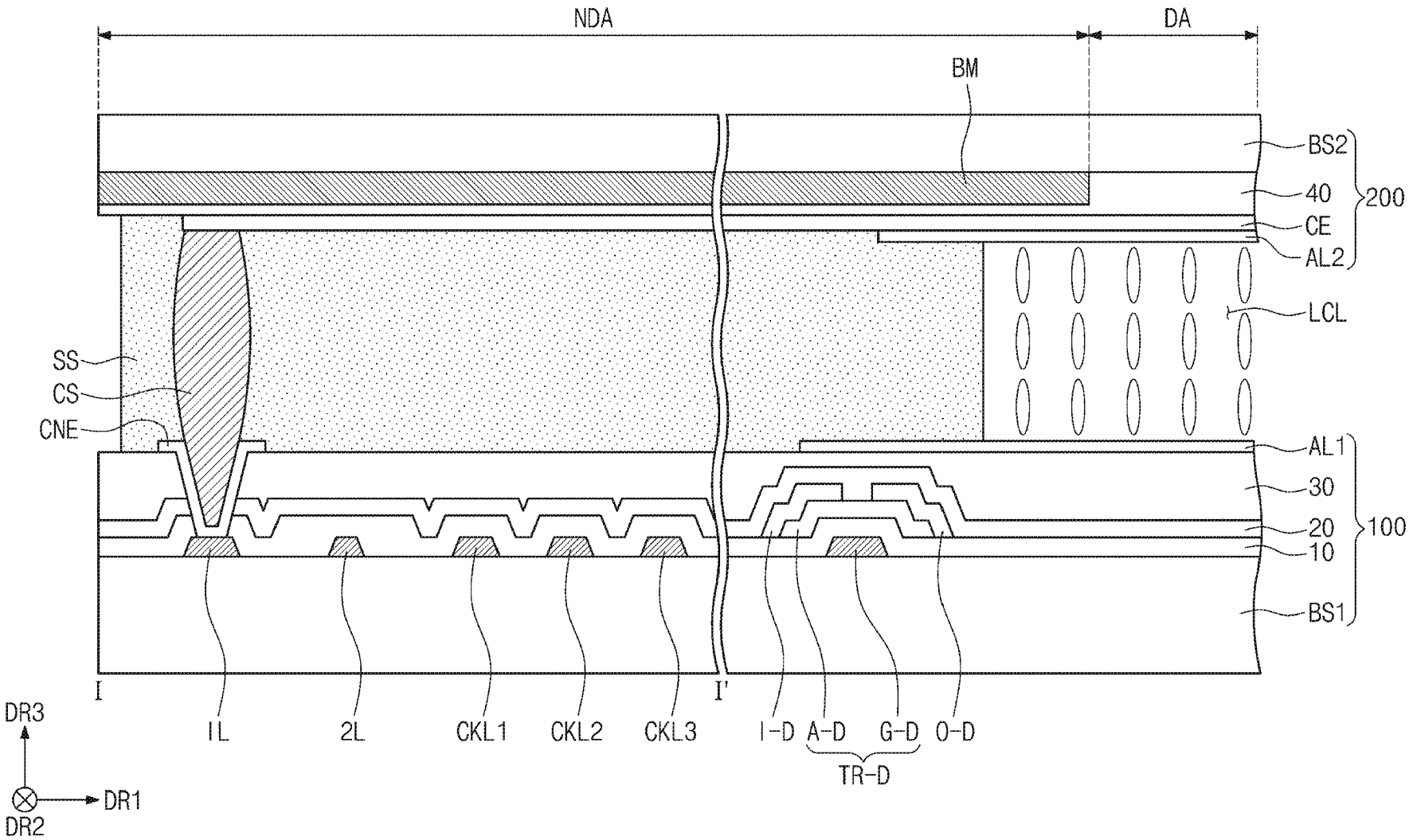
FIG. 7B is a sectional view illustrating a display panel according to an embodiment of the inventive concept.

FIG. 7A is an enlarged plan view illustrating an example of a region AA' of FIG. 2A or 2B. FIG. 7B is a sectional view illustrating a display panel according to an embodiment of the inventive concept. FIG. 7B illustrates a cross-section taken along a line I-I' of FIG. 7A. For concise description, an element previously described with reference to FIGS. 1 to 6 may be identified by the same reference number without repeating an overlapping description thereof.

Referring to FIGS. 7A and 7B, the display panel DP may include the first display substrate 100 and the second display substrate 200.

The first display substrate 100 may include the first base substrate BS1, the first insulating layer 10, the second insulating layer 20, the third insulating layer 30, and the first alignment layer ALL The second display substrate 200 may include the second base substrate BS2, the fourth insulating layer 40, the common electrode CE, the light-blocking pattern BM, and the second alignment layer AL2.

Referring to FIG. 7A, the display panel DP may include the first line 1L, the second line 2L, a plurality of clock signal lines CKL1 to CKLn, a plurality of clock bar signal lines CKBL1 to CKBLn, a first reference signal line VSL1, a second reference signal line VSL2, and an initiation signal line STPL which are disposed on the first display substrate 100.

The first line 1L may receive the common voltage Vcom. The common voltage may have a voltage from about 4V to about 8V. The first line 1L may be the common line 1L which is used to apply the common voltage Vcom to the display region DA. In an embodiment, the first line 1L may apply a common voltage to the common electrode CE disposed on the second base substrate BS2. The first line 1L may be disposed at the outermost region of the non-display region NDA. For example, there is no signal line between the first line 1L and an edge of the first display substrate 100 which is most adjacent to the first line 1L.

The second line 2L may be disposed between a first clock signal line CKL1 of the clock signal lines CKL1 to CKLn which is most adjacent to the first line 1L and the first line 1L. The second line 2L may serve as a shielding element preventing the signal interference between the first line 1L and the first clock signal line CKL1. The second line 2L may be referred to as a shield line 2L.

In detail, the first line 1L and the first clock signal line CKL1 may be spaced apart from each other by a predetermined distance to prevent the signal interference therebetween. The predetermined distance may be larger than distances between the clock signal lines CKL1 to CKLn. Here, the predetermined distance may be about 40 μm. Even when the distance between the first line 1L and the first clock signal line CKL1 is 40 μm, there may be an interference issue between the common signal and the first clock signal. For example, capacitance between the first line 1L and the first clock signal line CKL1 may have a value greater than capacitance between other clock signal lines CKL2 to CKLn and the common electrode CE, and this may lead to a change in brightness of a specific pixel.

The second line 2L may be used to reduce the capacitance between the first line 1L and the first clock signal line CKL1. In an embodiment, a width of the second line 2L may range from 10 μm to 15 μm. The width of the second line 2L may be smaller than a width of the first line 1L and may be smaller than widths of the clock signal lines CKL1 to CKLn.

The second line 2L may not be a portion of the gate driving circuit GDC and a predetermined signal can be applied to the second line 2L. In an embodiment, the second line 2L may receive the ground voltage. For example, the second line 2L may be applied with a voltage of 0 V, but in an embodiment, a voltage of 6V to 9V may be applied to the second line 2L. The second line may be applied with a voltage less than the common voltage. In an embodiment, the second line 2L may include a plurality of ground lines each of which receives the ground voltage. In another embodiment, the second line 2L may be a floating line which is not connected to any voltage source.

Each of the clock signal lines CKL1 to CKLn may receive the clock signal CKV. Each of the clock bar signal lines CKBL1 to CKBLn may receive the clock bar signal CKVB.

The first reference signal line VSL1 may receive the first reference voltage VSS1. The second reference signal line VSL2 may receive the second reference voltage VSS2. The initiation signal line STPL may receive an initiation voltage STPV. The initiation signal line STPL may be disposed between the first reference signal line VSL1 and the second reference signal line VSL2.

The first reference signal line VSL1, the second reference signal line VSL2, and the initiation signal line STPL may be disposed closer to the display region DA (e.g., see FIG. 1) than the clock signal lines CKL1 to CKLn and the clock bar signal lines CKBL1 to CKBLn.

Referring to FIG. 7B, the display panel DP may include a sealant SS, which is used to couple the first display substrate 100 to the second display substrate 200. The sealant SS may include a synthetic resin and inorganic fillers, which are mixed with the synthetic resin. The synthetic resin of the sealant SS may further include at least one additive agent. The additive agent may include an amine-based hardener and a photo-initiator. The additive agent may further include a silane-based additive agent and an acryl-based additive agent.

In the present embodiment, the sealant SS is illustrated to be a single element coupling the first display substrate 100 to the second display substrate 200 but the inventive concept is not limited to this example. The sealant SS may include a plurality of portions that are spaced apart from each other in the first direction DR1. The sealant SS may cover the clock signal lines CKL1 to CKLn, the first line 1L, and the second line 2L. Although first to third clock signal lines CKL1, CKL2, and CKL3 are illustrated in FIG. 7B, but the inventive concept is not limited to this example. For example, the clock signal lines CKL1 to CKLn may include first to eighth clock signal lines CKL1 to CKL8.

In an embodiment, the first line 1L, the second line 2L, and the clock signal lines CKL1 to CKLn may be formed of a same material through a same process and disposed on the same layer. For example, all of the first line 1L, the second line 2L, and the clock signal lines CKL1 to CKLn may be disposed on the first base substrate BS1. Only some (e.g., the first to third clock signal lines CKL1, CKL2, and CKL3) of the clock signal lines CKL1 to CKLn are exemplarily illustrated in FIG. 7B. The first clock signal line CKL1 may be disposed at a region that is most adjacent to the second line 2L.

The second display substrate 200 may include the common electrode CE, which is in contact with the sealant SS. The common electrode CE may apply the common voltage to the display region DA. The column spacer CS may be disposed between the first display substrate 100 and the second display substrate 200. The column spacer CS may maintain the cell gap. The column spacer CS may be formed of or include an insulating material. The column spacer CS may be formed of or include a synthetic resin. The column spacer CS may be formed of or include a photo-sensitive organic material. The column spacer CS may be overlapped with a region of the display region DA on which the light-blocking pattern BM is disposed. In an embodiment, the column spacer CS may be used to transfer signals from the first display substrate 100 to the second display substrate 200.

Referring to FIG. 6, each of the stage circuits SRC1 to SRCn may include at least one transistor. One (hereinafter, a driving transistor TR-D) of such transistors is exemplarily illustrated in FIG. 7B.

The driving transistor TR-D may be the same stacking structure as the pixel transistor TR described with reference to FIG. 5. A control electrode G-D of the driving transistor TR-D and the control electrode GE of FIG. 5 may be disposed on the same layer and may be formed by the same process to have the same stacking structure. In other words, the control electrode G-D of the driving transistor TR-D and the control electrode GE of the pixel transistor TR may include the same material, may have the same stacking structure, and may be disposed on the same layer. An input electrode I-D and an output electrode O-D of the driving transistor TR-D and the input electrode IE and the output electrode OE of FIG. 5 may be disposed on the same layer and may be formed by the same process. A connection electrode CNE and the pixel electrode PXE of FIG. 5 may be disposed on the same layer and may be formed by the same process. In terms of the equivalent circuit diagram, the connection electrode CNE may constitute a portion of the gate driving circuit.

Figure 8A:
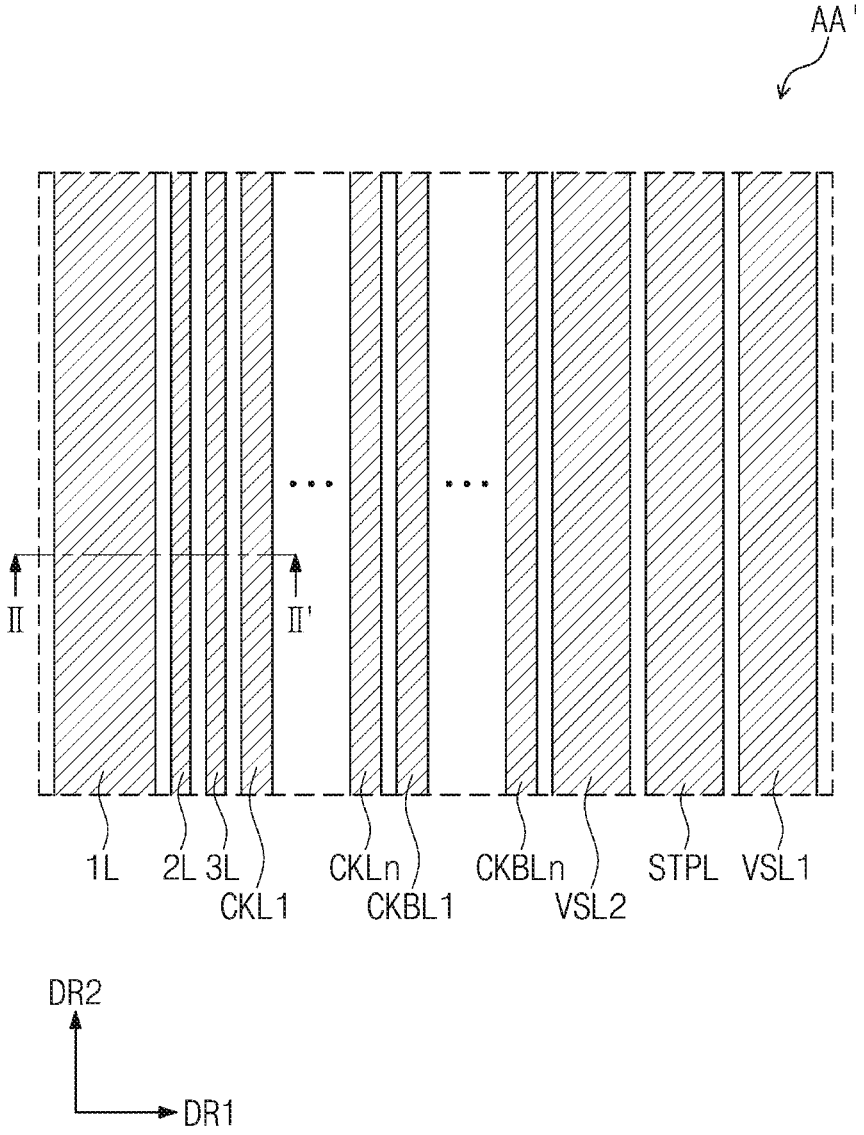
FIG. 8A is an enlarged plan view illustrating the region AA' of FIG. 2A.
Figure 8B:
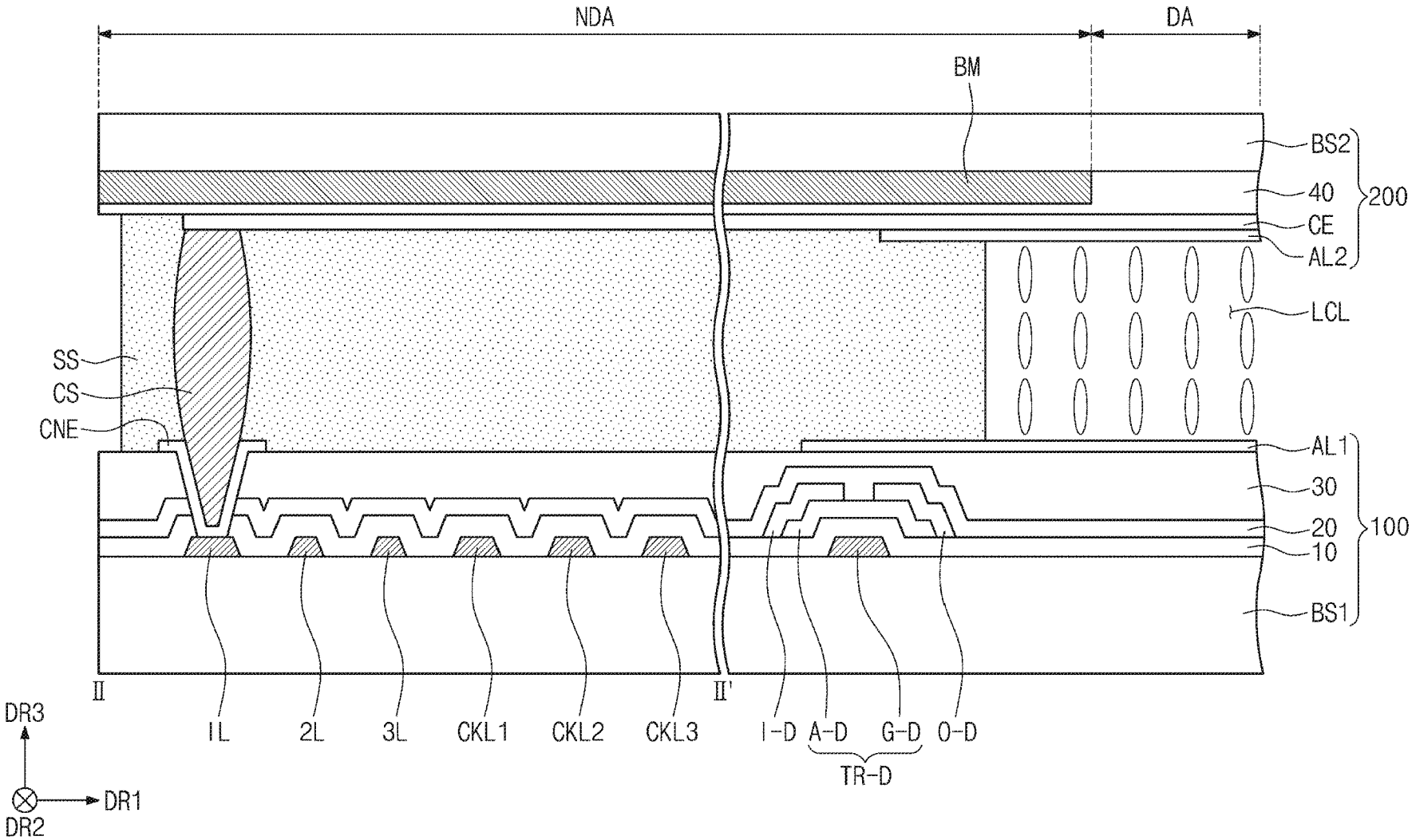
FIG. 8B is a sectional view illustrating a display panel according to an embodiment of the inventive concept.

FIG. 8A is an enlarged plan view illustrating an example of a region AA' of FIG. 2A or 2B. FIG. 8B is a sectional view illustrating a display panel according to an embodiment of the inventive concept. FIG. 8B illustrates a cross-section taken along a line II-IT of FIG. 8A. For concise description, an element previously described with reference to FIGS. 1 to 7B may be identified by the same reference number without repeating an overlapping description thereof.

Referring to FIGS. 8A and 8B, the first display substrate 100 of the display panel DP may further include a third line 3L provided between the second line 2L and the first clock signal line CKL1. For example, the first display substrate 100 may include the second line 2L and the third line 3L which are disposed between the first line 1L and the first clock signal line CKL1 of the clock signal lines CKL1 to CKL3 most adjacent to the first line 1L. In an embodiment, one of the second line 2L and the third line 3L may receive the ground voltage VGND, and the other may be a floating line. For example, the second line 2L may receive the ground voltage, and the third line 3L may be the floating line. The second line 2L may be used as a shielding element between the first line 1L and the first clock signal line CKL1, and the third line 3L may be used as a shielding element between the second line 2L and the first clock signal line CKL1. The second line 2L and the third line 3L may be referred to as shield lines.

The shielding elements may not be limited to the second line 2L and the third line 3L, and in an embodiment, at least one shield line may be disposed between the first line 1L and the first clock signal line CKL1. For example, three or more shield lines may be disposed between the first line 1L and the first clock signal line CKL1.

At least two of the shield lines may be disposed on the same layer. For example, the shield lines may be disposed on the first base substrate BS1.

Tables 1 and 2 show technical effects according to an embodiment of the inventive concept.

TABLE 1

| | | CON | EX1 | EX2 |
|---|---|---|---|---|
| CKL* − Vcom | CKL1= | 6.802E−12 | 6.674E−12 | 6.671E−12 |
| | CKL2= | 6.622E−12 | 6.622E−12 | 6.622E−12 |

TABLE 1-continued

| | | CON | EX1 | EX2 |
|---|---|---|---|---|
| | CKL3= | 6.607E−12 | 6.607E−12 | 6.607E−12 |
| | CKL4= | 6.595E−12 | 6.595E−12 | 6.595E−12 |
| | CKL5= | 6.582E−12 | 6.582E−12 | 6.582E−12 |
| | CKL6= | 6.573E−12 | 6.573E−12 | 6.573E−12 |
| | CKL7= | 6.562E−12 | 6.562E−12 | 6.562E−12 |
| | CKL8= | 6.543E−12 | 6.544E−12 | 6.543E−12 |
| | CKBL1= | 6.534E−12 | 6.534E−12 | 6.534E−12 |
| | CKBL2= | 6.518E−12 | 6.518E−12 | 6.518E−12 |
| | CKBL3= | 6.512E−12 | 6.512E−12 | 6.512E−12 |
| | CKBL4= | 6.499E−12 | 6.499E−12 | 6.499E−12 |
| | CKBL5= | 6.490E−12 | 6.490E−12 | 6.490E−12 |
| | CKBL6= | 6.475E−12 | 6.475E−12 | 6.475E−12 |
| | CKBL7= | 6.459E−12 | 6.459E−12 | 6.459E−12 |
| | CKBL8= | 6.511E−12 | 6.511E−12 | 6.511E−12 |
| (Max − Min)/Average | | 5.22% | 3.28% | 3.23% |

TABLE 2

| | | CON | EX1 | EX2 |
|---|---|---|---|---|
| CKL * CAP | CKL1= | 1.299E−11 | 1.300E−11 | 1.299E−11 |
| | CKL2= | 1.299E−11 | 1.299E−11 | 1.299E−11 |
| | CKL3= | 1.299E−11 | 1.299E−11 | 1.299E−11 |
| | CKL4= | 1.297E−11 | 1.297E−11 | 1.297E−11 |
| | CKL5= | 1.295E−11 | 1.295E−11 | 1.295E−11 |
| | CKL6= | 1.294E−11 | 1.294E−11 | 1.294E−11 |
| | CKL7= | 1.293E−11 | 1.293E−11 | 1.293E−11 |
| | CKL8= | 1.292E−11 | 1.292E−11 | 1.292E−11 |
| | CKBL1= | 1.291E−11 | 1.291E−11 | 1.291E−11 |
| | CKBL2= | 1.289E−11 | 1.289E−11 | 1.289E−11 |
| | CKBL3= | 1.288E−11 | 1.288E−11 | 1.288E−11 |
| | CKBL4= | 1.287E−11 | 1.287E−11 | 1.287E−11 |
| | CKBL5= | 1.286E−11 | 1.286E−11 | 1.286E−11 |
| | CKBL6= | 1.285E−11 | 1.285E−11 | 1.285E−11 |
| | CKBL7= | 1.283E−11 | 1.283E−11 | 1.283E−11 |
| | CKBL8= | 1.279E−11 | 1.279E−11 | 1.279E−11 |
| (Max − Min)/Average | | 1.51% | 1.62% | 1.52% |

In Tables 1 and 2, the clock signal lines may include first to eighth clock signal lines CKL1 to CKL8, and the clock bar signal lines may include first to eighth clock bar signal lines CKBL1 to CKBL8. CON represents the conventional case, EX1 represents a first embodiment in which the second line 2L receiving the ground voltage of FIGS. 7A and 7B is disposed, and EX2 represents a second embodiment, in which the second line 2L receiving the ground voltage of FIGS. 8A and 8B and the third line 3L serving as the floating line are disposed.

In Table 1, CKL*−Vcom represents a capacitance between each of the clock signal lines CKL1 to CKLn and the common electrode CE and between each of the clock bar signal lines CKBL1 to CKBLn and the common electrode CE.

A difference or variation in capacitance between each of the clock signal lines and the common voltage and between each of the clock bar signal lines and the common voltage may lead to a difference in brightness between pixels. If the difference is larger than 5%, a failure, in which a horizontal line is produced on a display screen, may occur due to the difference in brightness between the pixels.

Referring to Table 1, in the conventional case CON, the capacitance of the first clock signal line CKL1 minus the common electrode CE was 6.802E-12, whereas capacitances of other clock signal lines CKL2 to CKL8 or the first to eighth clock bar signal lines CKBL1 to CKBL8 minus the common electrode CE ranged from 6.475E-12 to 6.622E-12. That is to say, in the conventional case CON, owing to a difference in capacitance between the first clock signal line CKL1 and the common line 1L adjacent to each other, the capacitance between the first clock signal line CKL1 and the common electrode CE was higher than the capacitances between other clock signal lines and the common electrode CE. Accordingly, a variation in capacitance values between the clock signal lines and the common electrode CE was 5.22% and was greater than 5%.

In the first and second embodiments EX1 and EX2, since the second line 2L receiving the ground voltage and the third line 3L serving as the floating line are disposed between the first line 1L and the first clock signal line CKL1, the capacitance between the first clock signal line CKL1 and the common electrode CE are similar to the capacitances between other clock signal lines CKL2 to CKL8 and the common electrode CE and between the clock bar signal lines CKBL1 to CKBL8 and the common electrode CE. Accordingly, a variation in capacitance values between the clock signal lines and the common electrode CE was 3.28% and 3.23% in the first and second embodiments EX1 and EX2 respectively and was less than 5%.

In Table 2, CKL*CAP represents a value of the capacitance load of each of the clock signal lines CKL1 to CKLn.

Referring to Table 2, despite of the technical effect described with reference to Table 1, the first clock signal line CKL1 in the first embodiment EX1 had the capacitance load of 1.300E-11 which was increased relative to the conventional case. Thus, a variation in capacitance load between the clock signal lines CKL1 to CKLn and the clock bar signal lines CKBL1 to CKBLn was increased to 1.62%. However, along with the embodiment of Table 1, the capacitance load of the first clock signal line CKL1 in the second embodiment EX2 was maintained to the existing value of 1.299E-11. Thus, in the case where the second and third lines 2L and 3L which are respectively used as the ground and floating lines, are disposed between the first line 1L and the first clock signal line CKL1, the capacitance load between the clock signal lines CKL1 to CKLn and the clock bar signal lines CKBL1 to CKBLn was maintained to the existing value of 1.51%.

According to an embodiment of the inventive concept, a ground interconnection line and/or a floating interconnection line may be additionally disposed between a common interconnection line and a clock interconnection line, which are adjacent to each other, and this may make it possible to prevent a variation in brightness between pixels caused by capacitance between the common and clock interconnection lines. In detail, according to an embodiment of the inventive concept, it may be possible to prevent a horizontal line, which is caused by the variation in brightness between the pixels, from occurring in a display region.

While example embodiments of the inventive concept have been particularly shown and described, it will be understood by one of ordinary skill in the art that variations in form and detail may be made therein without departing from the spirit and scope of the attached claims.

What is claimed is:

1. A display device, comprising a display panel including a first display substrate which includes a display region in which pixels are disposed and a non-display region disposed adjacent to the display region, wherein the first display substrate comprises:

a first line disposed in the non-display region to apply a common voltage to the display region;

a gate driving circuit disposed in the non-display region between the display region and the first line;

a plurality of gate lines connected to the gate driving circuit; and a second line disposed between the first line and the gate driving circuit, wherein the gate driving circuit comprises:

a plurality of clock signal lines, each of which receives a clock signal; and stage circuits connected to a corresponding one of the clock signal lines and a corresponding one of the gate lines to output gate signals, and wherein the second line is disposed between the first line and one of the clock signal lines which is disposed closest to the first line, and is electrically disconnected from the stage circuits.

2. The display device of claim 1, wherein the second line receives a ground voltage.

3. The display device of claim 2, wherein the second line is provided in plural.

4. The display device of claim 1, wherein the second line is a floating line that is electrically isolated.

5. The display device of claim 1, wherein the first display substrate further comprises a third line disposed between the gate driving circuit and the second line.

6. The display device of claim 5, wherein one of the second line and the third line receives a ground voltage, and the other is a floating line that is electrically isolated.

7. The display device of claim 1, further comprising a second display substrate facing the first display substrate, wherein the second display substrate comprises a base substrate and a common electrode disposed on the base substrate, and wherein the common electrode receives the common voltage.

8. The display device of claim 7, further comprising a sealant combining the first display substrate with the second display substrate, wherein the sealant covers the plurality of clock signal lines, the first line, and the second line.

9. The display device of claim 1, wherein the first line, the second line, and the clock signal lines are formed of a same material and disposed on a same layer.

10. The display device of claim 1, wherein any signal line is not disposed between an edge of the first display substrate which is disposed closest to the first line and the first line in a plan view.

11. The display device of claim 1, wherein each of the stage circuits comprises at least one driving transistor.

12. The display device of claim 11, wherein the pixel comprises a pixel transistor which outputs a pixel voltage in response to a corresponding one of the gate signals and the pixel transistor and the at least one driving transistor have a same stacking structure.

13. The display device of claim 12, wherein a control electrode of the pixel transistor, a control electrode of the at least one driving transistor, and the first line are formed of a same material and disposed on a same layer.

14. A display panel, comprising a first display substrate including a display region and a non-display region disposed adjacent to the display region;

a second display substrate facing the first display substrate; and a sealant overlapped with the non-display region to combine the first display substrate with the second display substrate, wherein the first display substrate comprises:

a common line disposed in the non-display region to apply a common voltage to the display region;

a gate driving circuit disposed in the non-display region, the gate driving circuit comprising a plurality of clock signal lines and a stage circuit which is connected to the plurality of clock signal lines; and at least one shield line disposed between the common line and the gate driving circuit, and wherein the at least one shield line is disposed between the common line and one of the clock signal lines which is disposed closest to the common line, and is electrically disconnected from the stage circuits.

15. The display panel of claim 14, wherein the second display substrate comprises a common electrode in contact with the sealant and the common electrode receives the common voltage.

16. The display panel of claim 14, wherein a distance between the common line and one of the clock signal lines which is disposed closest to the common line is larger than a distance between the clock signal lines.

17. The display panel of claim 14, wherein a width of the at least one shield line is smaller than a width of the common line and widths of the plurality of clock signal lines.

18. The display panel of claim 14, wherein a width of the at least one shield line ranges from 10 μm to 15 μm.

19. The display panel of claim 14, wherein the at least one shield line applies a ground signal to the display region.

20. The display panel of claim 14, further comprising a plurality of data driving circuits which are arranged in a first direction, and each of which includes a circuit board and a driving chip, wherein the data driving circuits comprise a first data driving circuit and a second data driving circuit which are disposed at opposite sides of the display panel, an end of each of the common line and the shield line is connected to the first data driving circuit, and an opposite end of each of the common line and the shield line is connected to the second data driving circuit.

* * * * *